United States Patent [19]

Barnard

[11] 4,317,344

[45] Mar. 2, 1982

[54] PROTECTIVE TWO-PIECE COVER BOOTS FOR PADLOCKS

[76] Inventor: Robert L. Barnard, 8924 Cheltonham Pl., Annandale, Va. 22003

[21] Appl. No.: 96,586

[22] Filed: Nov. 21, 1979

[51] Int. Cl.[3] ..... E05B 67/38

[52] U.S. Cl. ..... 70/55

[58] Field of Search ..... 70/54, 55, 56, 455; 150/52 R

[56] References Cited

U.S. PATENT DOCUMENTS

| | | | |
|---|---|---|---|
| 1,581,953 | 4/1926 | Jackson . | |
| 1,662,612 | 3/1928 | Junkune . | |
| 2,585,331 | 2/1952 | King | 70/455 |
| 3,858,419 | 1/1975 | Hampton . | |
| 3,983,725 | 10/1976 | Manuel . | |

*Primary Examiner*—Robert L. Wolfe

*Attorney, Agent, or Firm*—Nathan Edelberg; Robert P. Gibson

[57] ABSTRACT

A pair of anti-dust and anti-moisture protective cover boots fabricated of a resilient and pliable soft molded material such as polyurethane plastic, or the like, to respectively fit snugly over the shackle bight, shackle legs and adjacent top end of a padlock case, and also to fit over the cylinder/key end or lower end of the case. The top cover boot for the shackle end is provided with spaced holes to snugly accommodate the legs of the shackle, and has a self-closing slit interconnecting the spaced holes to permit the boot to be yieldingly slipped snugly over the shackle and onto the adjacent end of the case. The other generally similar bottom boot has a shorter, angularly disposed self-closing slit provided generally centrally in its end wall to provide key access. The plane of the slit is disposed obliquely relative to the inner and outer surfaces of the end wall to reduce likelihood of entry of moisture and dust. The boot material is sufficiently resilient to permit both key turning therein and to be self-closing after removal of the key.

13 Claims, 7 Drawing Figures

FIG. 1.
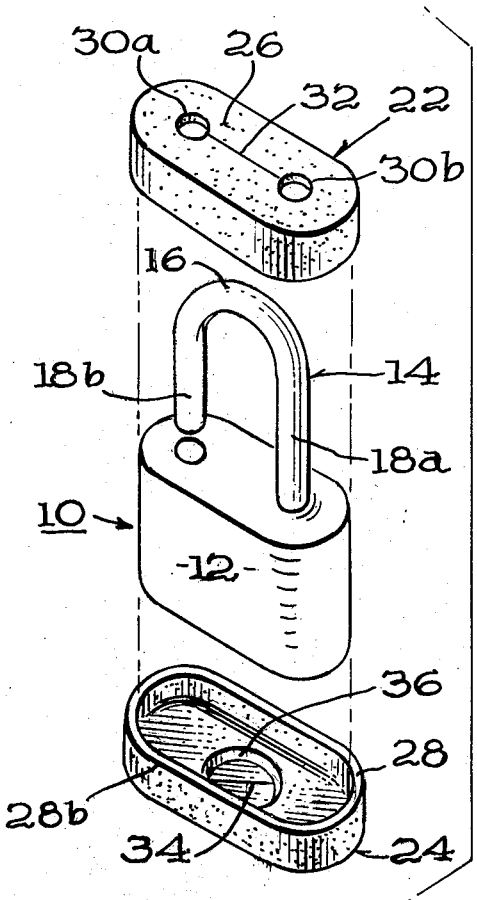
FIG. 2.
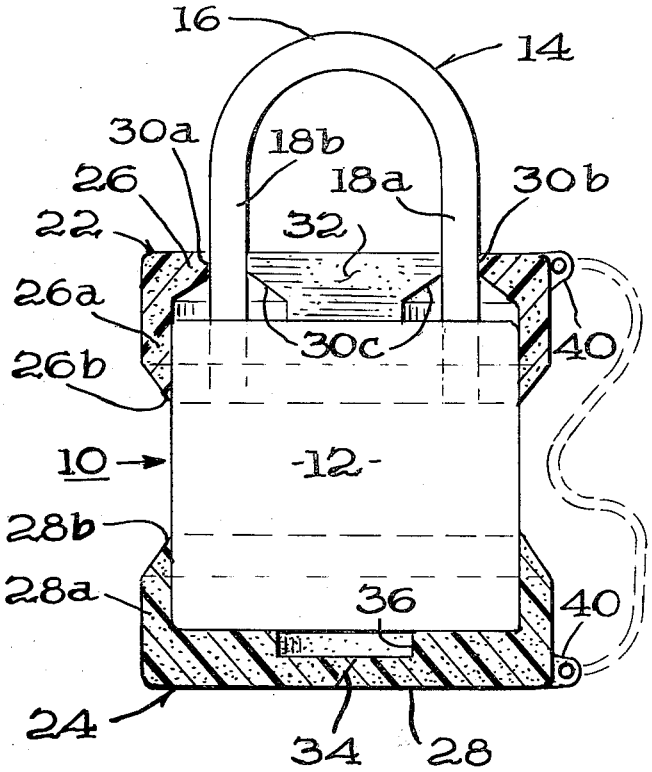
FIG. 7
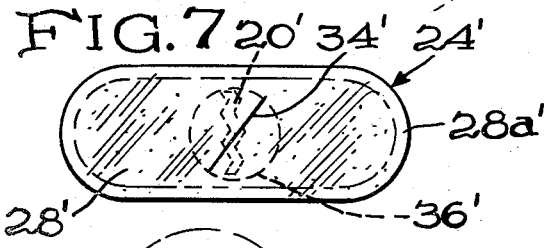
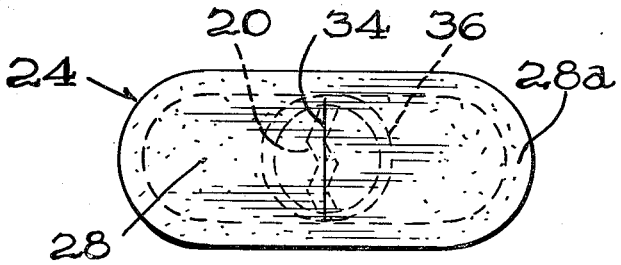
FIG. 3.
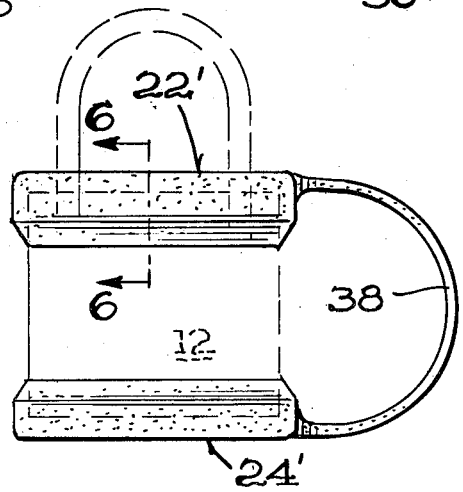
FIG. 5.
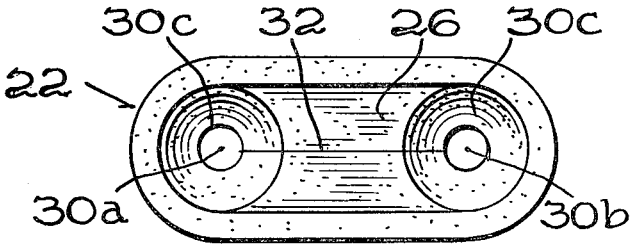
FIG. 4.
FIG. 6.
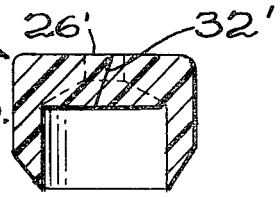

PROTECTIVE TWO-PIECE COVER BOOTS FOR PADLOCKS

DEDICATORY CLAUSE

The invention described herein may be manufactured, used and licensed by or for the Government for governmental purposes without the payment to me of any royalties thereon.

FIELD OF INVENTION

The invention relates to pliable protective cover boots to protect the inner and working parts of a padlock from being ruined by direct and indirect deleterious exposure to dust, dirt, mud, sand, water, ice, and other moisture or rain-like atmospheric conditions.

BACKGROUND OF THE INVENTION

Padlocks are undoubtedly among some of the simplest and most convenient of various types of security devices. Padlocks are commonly exposed to the various elements of nature and thus can become ruined in a relatively short time by harmful elements.

While various protective covers for padlocks have been previously devised (U.S. Pat. Nos. 1,581,953, 1,662,612 3,858,419, and 3,983,725), it is the main object of this invention to provide further novelly improved protective cover means to preserve a padlock in good working condition notwithstanding being subjected to a variety of deleterious elements.

BRIEF SUMMARY OF THE INVENTION

The improved protective cover means of this invention include a complemental pair of anti-dust and anti-moisture sealing boots fabricated of a pliable soft molded material such as polyurethane plastic or similar material. A top boot is designed to fit snugly over the shackle bight, legs, and the adjacent upper shackle end of the padlock case. The other of the pair is a bottom boot to fit snugly over the cylinder/key or lower end of the case. In previous protective covers of this type, the shackle end cover contained nonconnected spaced holes to sequentially receive the legs of the shackle therethrough by being threaded first into one of the holes and then back into the other. In the present improved protective cover means, the top cover or boot for the shackle end is provided with a self-closing slit interconnecting the spaced shackle leg holes. The slit permits the boot to be more readily yieldably slipped over the shackle and snugly onto the case. Relative to the other cover or bottom boot for protecting the cylinder/key end of the case, while one such similar prior device (U.S. Pat. No. 1,662,612) is provided with a slot in a generally similar cover piece, the present improved corresponding cover has a self-closing key access slit in one embodiment, which is disposed not only angularly to the major and minor planes of the lock casing, but also is oblique to the outside and to the inside of the cover wall material to lessen likelihood of entry of detrimental elements. The resiliency of the covers is such as to permit the key to turn, and for the respective slits to be self-closing after respective assembly and removal of the key.

The above improved features and other objects and advantages of the invention will become more apparent from the following more detailed description, taken in conjunction with the accompanying illustrative drawings.

BRIEF DESCRIPTION OF THE DRAWINGS

FIG. 1 is a perspective view of a padlock and the subject improved protective boots or covers shown in exploded relation to the padlock;

FIG. 2 is an enlarged longitudinal cross-sectional view taken through the protective cover boots assembled on a padlock casing, the latter being shown in elevation outline;

FIG. 3 is a bottom plan view of the protective cover boot adapted to fit snugly on the key end of the padlock;

FIG. 4 is a plan view of the inner face of the upper protective cover boot adapted to fit snugly over the shackle end on the adjacent end of the padlock case;

FIG. 5 is side elevational view of a modified embodiment having the protective cover boots shown interconnected by a flexible strap or tie string;

FIG. 6 is a transverse cross-sectional view taken on line 6—6 of a modified form of the slit in the FIG. 5 alternate embodiment of a top cover boot; and FIG. 7 is a bottom plan view of still another modified embodiment of a bottom cover boot.

DETAILED DESCRIPTION OF A PREFERRED EMBODIMENT

FIGS. 1 and 2 show a conventional type padlock generally designated 10 having a body 12 and a shackle 14. The shackle 14 has a bight portion 16 connecting shackle legs **18*a* and 18*b*. A key slot 20, shown in dotted lines only in FIG. 3, is provided in the bottom end of the padlock body, and is adapted to receive a key (not shown) which can be turned to release a free end of the shackle leg 18*b* from the customary locked engagement with a lock mechanism (not shown) within the body 12**.

The protective cover means for the padlock include top and bottom cover boots 22 and 24 fabricated of resilient soft molded material such as polyurethane plastic or other suitable rubber-like material. Each cover boot 22 and 24 comprises a pliable planar end panel, 26 and 28 respectively, having a shape corresponding to that of the respective top and bottom ends of the particular type of padlock casing; and, each panel further includes an integrally formed marginal flange **26*a* and 28*a*, respectively, projecting a relatively short distance generally perpendicularly from each end panel. The marginal flanges are designed to snugly embrace the related end portions of the padlock casing, and said flanges preferably terminate in beveled or tapered edges 26*b* and 28*b***, respectively, to better facilitate and enhance the sealing characteristics, and to better shed precipitation and other moisture therefrom.

Referring more specifically to the top cover boot 22, the end panel 26 is provided with a pair of apertures **30*a*, 30*b* of a size just slightly smaller than the cross-sectional shape and area of the shackle legs so as to provide good sealing characteristics. The holes are spaced apart a distance corresponding to that between the centers of the shackle legs, and said end panel additionally is provided with a normally self-closing slit 32 interconnecting the aforesaid apertures 30*a*, 30*b*. The slit 32 thus facilitates yieldable assembly of the cover boot onto the top end of the padlock case by slipping it over the bight of the shackle. The top cover boot 22, in the areas of the respective shackle-leg-receiving holes 30*a*, 30*b*, is recessed preferably in a tapering or shallow conical manner as shown at 30*c* in FIG. 2**. While the plane of the slit 32, as shown in FIG. 2, is essentially perpendicular to the inner and outer planer surfaces of the end panel, it is understood that the plane of the slit also can be disposed in nonperpendicular angular relation thereto, if so desired, as shown by slit 32' in FIG. 6. The modified cover boot in FIG. 6 is designated 22' and the end or top generally planar panel is designated 26'.

Referring next more specifically to the bottom cover boot 24 in FIGS. 1–3, its end panel 28 is provided with a generally centrally disposed key-admitting slit 34 of self-closing character. The plane of the slit 34 is purposely not perpendicular to the inner and outer planar generally parallel surfaces of the end panel 28, to provide improved sealing characteristics. Additionally the inside face of the end panel 28 is preferably recessed in an area 36 around the key-admitting slit 34 to provide increased pliability and resilience to better facilitate non-detrimental key rotation distortion during unlocking of the padlock. Without such recessed area 36, the boot may have a tendency to be lifted away or off from the end of the lock casing, particularly if the depending flange 28*b* is not very long.

In the modified embodiment of FIG. 7, primed reference numerals are used to designate like or corresponding parts previously described relative to FIGS. 1–3. Therefore, no repetition of the basic boot description is required. In FIG. 7, the key-admitting slit 34' is of dual angular disposition evolving from structural relationships wherein (1) said slit is oriented obliquely to the major and minor planes of the lock's casing or body, and thus often may be oriented substantially different from the normal orientation of the padlock's key entrance, and (2) the plane of the key-admitting slit 34 is disposed also preferably at an oblique angle relative to inner and outer generally planar surfaces of the end panel 28' of said bottom cover boot 24'. Because of the potential non-alignment of the slit 34' and key entry 20' (FIG. 7), it may be desirable to fabricate the lower cover boot from a generally transparent material. Even where opaque materials are used, since the normal orientation of the key slot is usually on a line transverse to the major plane of the lock body, it would be relatively easy to empirically manually align the key with the key entry slot.

In order to better keep the related pair of protective cover boots together to assure maximum protection by the coaction of both boots on a given padlock, the pair of cover boots may be interconnected by any suitable flexible tie means. One example of the tie means is designated 38 in FIG. 5, and may have the form of a flexible narrow strap integrally formed of the same material as that used for the respective cover boots 22', 24'. Other forms may include merely a short length of string threaded through an eyelet or tab 40 (FIG. 2) provided on each cover boot.

From the foregoing detailed description, it is apparent that a best mode for carrying out the present invention has been shown and described. However, it is also apparent that certain modifications and variations may be made without departing from the spirit and scope of the claimed subject matter as set forth in the accompanying claims hereinafter.

What is claimed is:

1. Protective cover means for key-actuated, shackle type padlock casings wherein the padlock includes a bighted shackle having shackle legs operable at a top end, and having a key-operated locking mechanism housed within a casing, and an exposed key entrance in a lower end of a padlock casing, said cover means comprising top and bottom resilient cover boots adapted respectively to pass over and fit snugly around the shackle legs and over respective top and bottom end portions of a padlock case;

the top and bottom cover boots each comprising a pliable planar end panel having a shape corresponding to that of the respective top and bottom ends of the padlock casing, and each panel having an integrally formed marginal flange projecting generally perpendicular from said panel for snugly embracing the related end portion of said padlock casing; and said top cover boot's end panel having a pair of apertures of a size slightly smaller than the cross-sectional shape and area of the shackle legs, said apertures being spaced apart a distance corresponding to that between the shackle legs, and said end panel further having a self-closing slit interconnecting said spaced-apart apertures to facilitate application of the pliable boot over the shackle and onto the top end of said padlock casing.

2. Protective cover means as defined in claim 1, wherein said pliable bottom cover boot has a self-closing key-admitting slit disposed angularly through the said end panel generally opposite the key entrance of said padlock casing.

3. Protective cover means as defined in claim 1, wherein said end panel of the top cover boot has generally normally parallel inner and outer surfaces, and a plane through said slit interconnecting the shackle leg apertures is disposed at generally 90° relative to the latter aforesaid respective inner and outer surfaces.

4. Protective cover means as defined in claim 1, wherein said end panel of the top cover boot has generally normally parallel inner and outer surfaces, and a plane through said slit interconnecting the shackle leg apertures is disposed at an oblique angle relative the latter aforesaid inner and outer surfaces.

5. Protective cover means as defined in claim 1, wherein said end panel of the top cover boot has an inside surface which is recessed around each of the spaced apertures adapted to receive the legs of a padlock shackle, said recessed areas providing added resilience for both ease of assembly and improved leg-engaging sealing characteristics.

6. Protective cover means as defined in claim 1, wherein said marginal flanges of each boot's end panel terminate in tapered edges to enhance sealability and precipitation-shedding characteristics.

7. Protective cover means as defined in claim 1, wherein said top and bottom cover boots further include integrally formed flexible tie means interconnecting said boots for complemental coacting use with a given padlock.

8. Protective cover means as defined in claim 1, wherein said top and bottom cover boots respectively include means to receive flexible tie-string means to facilitate interconnecting said boots in related pairs.

9. Protective cover means as defined in claim 2, wherein said cover boots are molded of a pliable soft-polyurethane plastic material having memory characteristics to provide self-closing characteristics to the slit between the shackle leg apertures, and to the key-admitting slit.

10. Protective cover means as defined in claim 2, wherein said end panel of said bottom cover boot has generally parallel inner and outer surfaces, and a plane through said slit for key entry is disposed at an oblique angle relative to said inner and outer surfaces to constitute one form of said angular disposition of said slit.

11. Protective cover means as defined in claim 2, wherein the aforesaid key-admitting slit angularity is of dual character evolving from novel structural relationships including (a) said end panel of the bottom cover boot has generally normally parallel inner and outer surfaces, and a plane through said slit for key entry to the padlock casing is disposed at an oblique angle relative to the said inner and outer surfaces, and (b) wherein said bottom cover boot also has generally parallel opposed marginal side edges corresponding to like opposed side walls of a major dimension of a padlock casing with which it is to be associated, and wherein the boot's key-admitting slit is of oblique angular orientation relative to said boot's opposed marginal side edges.

12. Protective cover means as defined in claim 11, wherein at least said bottom cover boot is fabricated of a material having generally transparent characteristics.

13. Protective cover means as defined in claim 2, wherein said end panel of the bottom cover boot is recessed on an inside face in an area through which said key-admitting slit is formed, to thereby provide further pliability in that area to better facilitate key rotation distortion during unlocking use of the padlock with which the cover means may be associated.

* * * * *